US005097977A

United States Patent [19]

Straub

[11] Patent Number: 5,097,977

[45] Date of Patent: Mar. 24, 1992

[54] CLOSURE ASSEMBLY FOR CONTAINER

[76] Inventor: Roy Straub, 14917 La Cuarta St., Whittier, Calif. 90605

[21] Appl. No.: 661,877

[22] Filed: Feb. 27, 1991

[51] Int. Cl.[5] ..... B65D 39/00

[52] U.S. Cl. ..... 220/307; 220/306; 220/354

[58] Field of Search ..... 220/307, 306, 354, 315, 220/319, 324, 352, 320; 215/320, 317, 321

[56] References Cited

U.S. PATENT DOCUMENTS

| | | | |
|---|---|---|---|
| 484,779 | 10/1892 | Cone | 220/320 X |
| 2,828,789 | 4/1958 | Groendyk et al. . | |
| 2,885,108 | 5/1959 | Donoghue | 220/354 |
| 3,223,278 | 12/1965 | Allen . | |
| 4,105,121 | 8/1978 | Mascetti | 220/306 X |
| 4,180,179 | 12/1979 | Hoenig et al. . | |
| 4,296,871 | 10/1981 | Andersson . | |
| 4,312,459 | 1/1982 | Leach | 220/306 X |
| 4,356,930 | 11/1982 | Roper | 220/307 X |
| 4,397,404 | 8/1988 | Blanchette . | |
| 4,524,882 | 6/1985 | Buc | 220/306 |
| 4,619,373 | 10/1986 | Galer . | |
| 4,667,543 | 5/1987 | Galer | 220/307 X |
| 4,728,003 | 3/1988 | Davey | 220/306 X |
| 4,887,735 | 12/1989 | Dudzik | 220/307 |
| 9,577,776 | 3/1986 | Rayner et al. | 220/306 X |

*Primary Examiner*—Stephen Marcus
*Assistant Examiner*—Paul A. Schwarz
*Attorney, Agent, or Firm*—Poms, Smith, Lande & Rose

[57] ABSTRACT

A closure assembly for a container having a snap ring connected to the top of the container and a lid that may be easily attached to and later removed from the ring. The snap ring has a plurality of engaging members with grooves therein integrally formed at an annular inside surface thereof, and equally spaced circumferentially around the ring. The lid has an annular bead at an outer circumferential surface that engages the grooves of the engaging members when the lid is attached to the snap ring. Annular portions of the lid and ring also engage corresponding annular grooves of the lid and ring when the lid is attached to the top of the container, providing a secure seal. The lid may be easily removed from the snap ring by placing the end of a tool under the annular bead of the lid and prying the lid free of the container. Preferably the lid, snap ring and container are injection molded from plastic.

22 Claims, 4 Drawing Sheets

FIG. 7
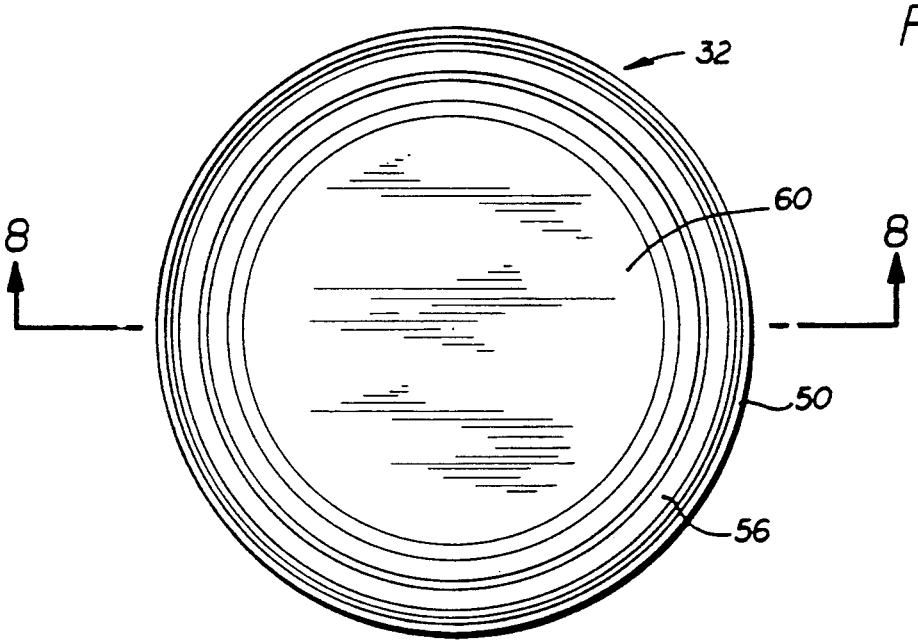
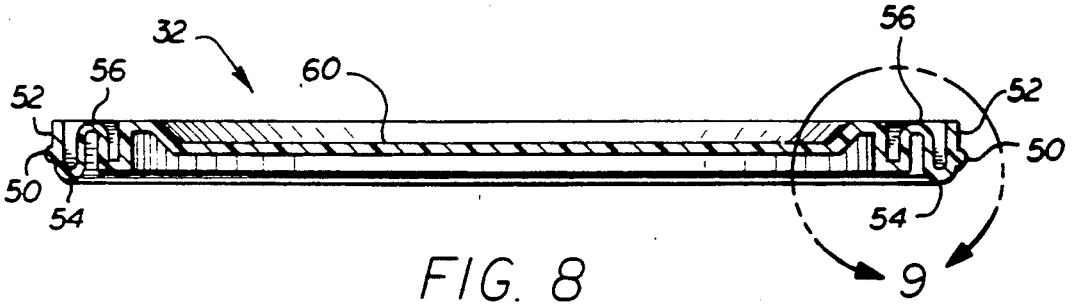
FIG. 8
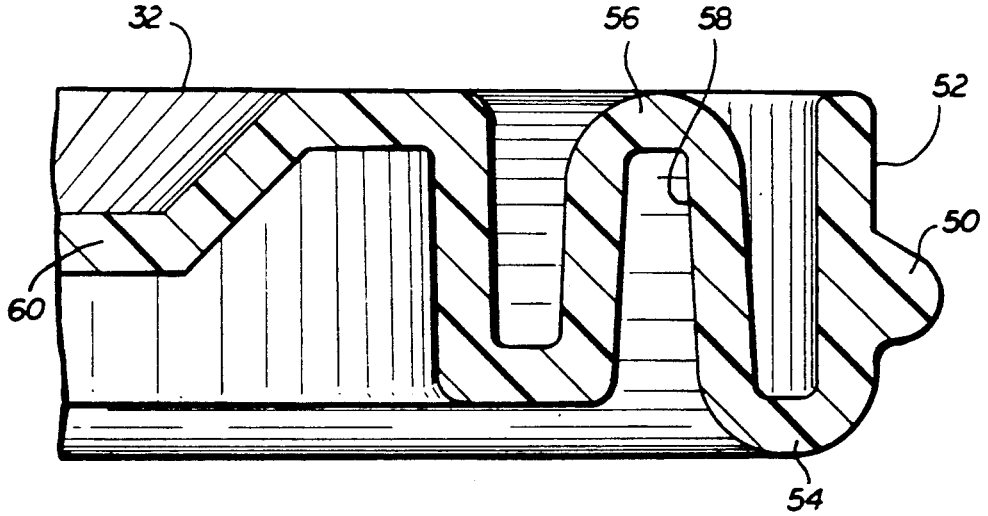
FIG. 9

CLOSURE ASSEMBLY FOR CONTAINER

BACKGROUND OF THE INVENTION

The present invention relates generally to containers with snap-shut lids, and more particularly to a closure assembly for a container having a lid with an annular bead thereon that releasably engages a plurality of engaging members located peripherally around a snap ring at the top of the container.

FIELD OF THE INVENTION

In the past, a variety of different means have been used to attach a lid to a container for the purpose of keeping the container shut and providing a seal between the lid and container. For example, closure means having a lid with a downwardly projecting portion that engages an annular channel in a rim of a container are disclosed in U.S. Pat. Nos. 2,828,789, issued to Groendyk et al. on Apr. 1, 1958; and 4,180,179, issued to Hoenig et al. on Dec. 25, 1979. Conversely, containers having upwardly projecting annular portions in rims of the containers that engage annual channels in lids are described in U.S. Pat. Nos. 3,223,278, issued to Allen on Dec. 14, 1965; and 4,296,871 issued to Andersson on Oct. 27, 1981.

U.S. Pat. No. 4,397,404, issued to Blanchette on Aug. 9, 1983, shows a container having a lid and rim, each of which has an annular channel and annular projecting portion. The channel and projecting portion of the lid engage the channel and projecting portion of the rim sealing the lid to the container. Finally, U.S. Pat. No. 4,619,373, issued to Galer on Oct. 28, 1986, describes a lid with an annular bead that engages an annular groove in the rim of the container.

SUMMARY OF THE INVENTION

Most of the closure means described above are complicated and expensive to manufacture. Also, difficulty is often encountered while attaching and removing the lid. Accordingly, there is a need for an improved closure assembly that is simple to use with a container.

It is an object of the invention to provide a closure assembly for use with a container that allows a user to easily attach a lid to the container, and later remove the lid when desired.

It is another object of this invention to provide a closure assembly for use with a container that provides a desirable seal between the lid and container.

It is still another object of this invention to provide a closure assembly for use with a container that is simple in design and economical to manufacture.

It is still another object of this invention to provide a molded plastic closure assembly for use with a molded plastic container.

These and other objects and advantages are attained by a closure assembly for a container having a snap ring connected to the top of the container and a lid that may be easily attached to and later removed from the ring. The snap ring has a plurality of engaging members with grooves therein integrally formed at an annular inside surface thereof, and equally spaced circumferentially around the ring. The lid has an annular bead at an outer circumferential surface that engages the grooves of the engaging members when the lid is attached to the snap ring.

Annular portions of the lid and ring also engage corresponding annular grooves of the lid and ring when the lid is attached to the top of the container, providing a secure seal. The lid may be easily removed from the snap ring by placing the end of a tool under the annular bead of the lid and prying the lid free of the container. Preferably, the lid, snap ring and container are injection molded from plastic.

The various features of the present invention will be best understood together with further objects and advantages by reference to the following description of the preferred embodiments taken in conjunction with the accompanying drawings.

BRIEF DESCRIPTION OF THE DRAWINGS

FIG. 7 is a top plan view of a lid used with the container;

FIG. 8 is a cross-sectional view taken in the direction of arrows 8—8 shown in FIG. 7; and FIG. 9 is an enlarged detailed view of the lid taken as indicated by arrows 9 in FIG. 8.

DESCRIPTION OF THE PREFERRED EMBODIMENTS

The following specification taken in conjunction with the drawings sets forth the preferred embodiments of the present invention in such a manner that any person skilled in the art can make and use the invention. The embodiments of the invention disclosed herein are the best modes contemplated by the inventor for carrying out the invention in a commercial environment although it should be understood that various modifications can be accomplished within the parameters of the present invention.

Figure 1:
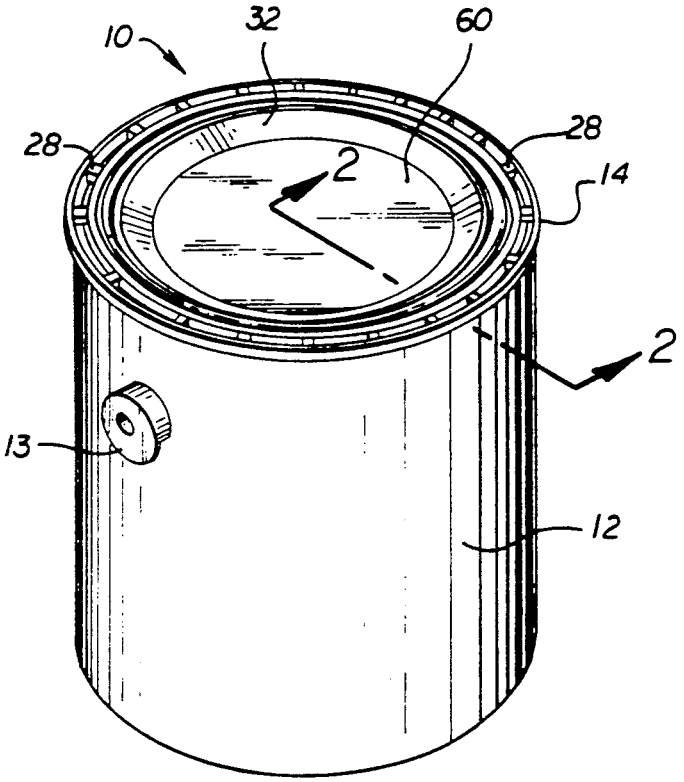
FIG. 1 is a perspective view of a container with a closure assembly illustrating the principles of the present invention.
Figure 2:
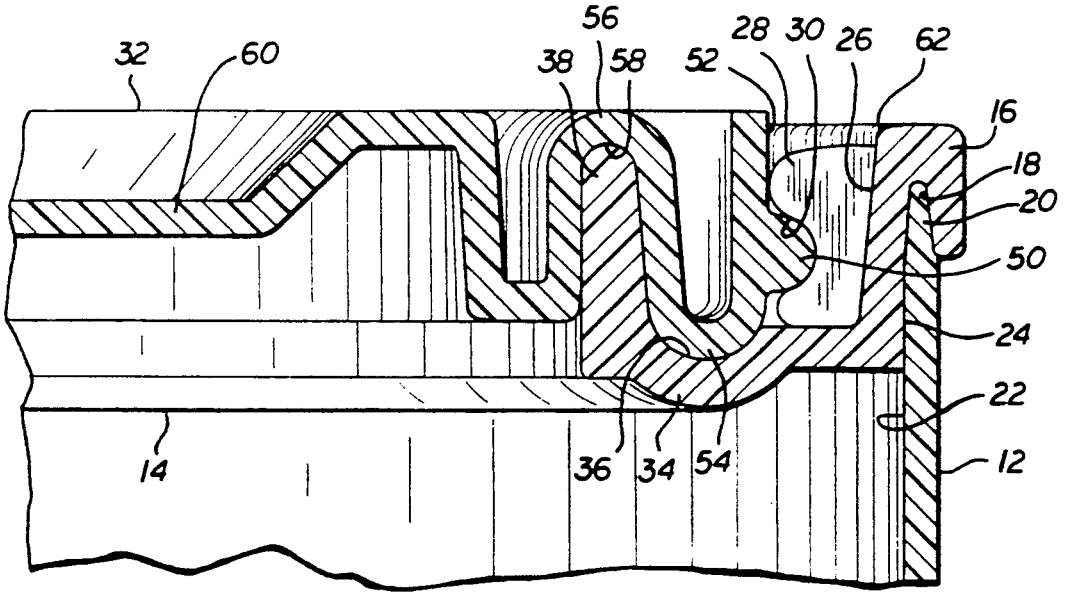
FIG. 2 is a cross-sectional view taken in the direction of arrows 2—2 shown in FIG. 1.
Figure 3:
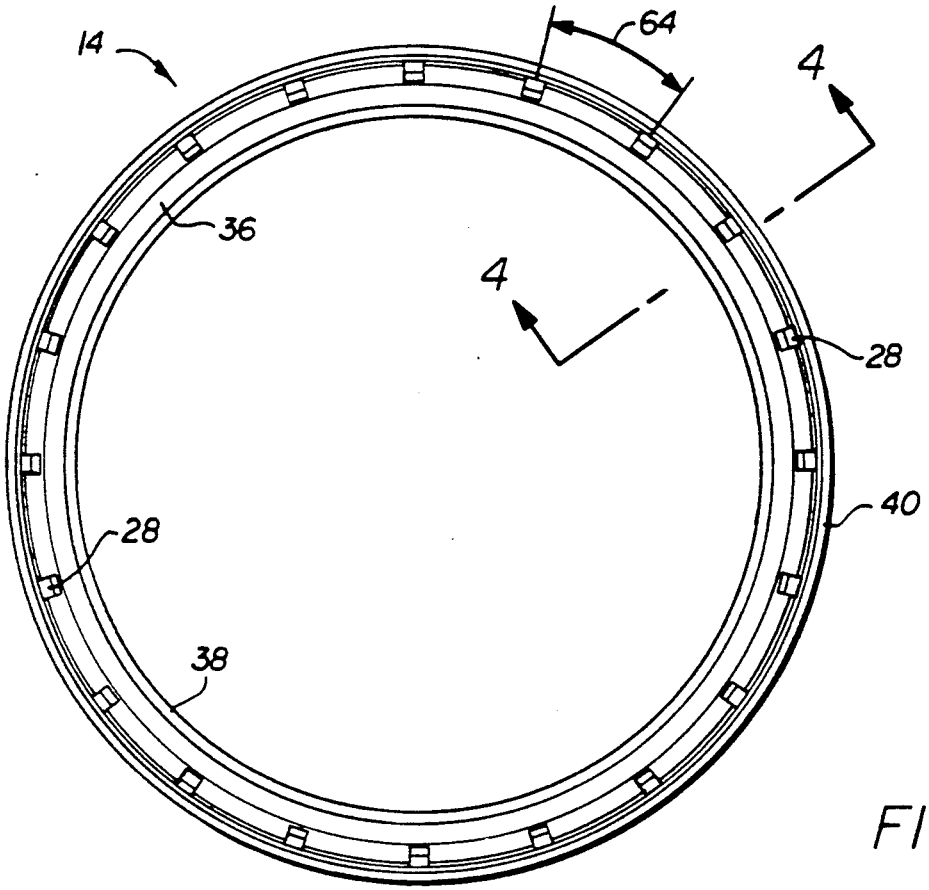
FIG. 3 is a top plan view of a snap ring adapted to be mounted on the container.
Figure 4:
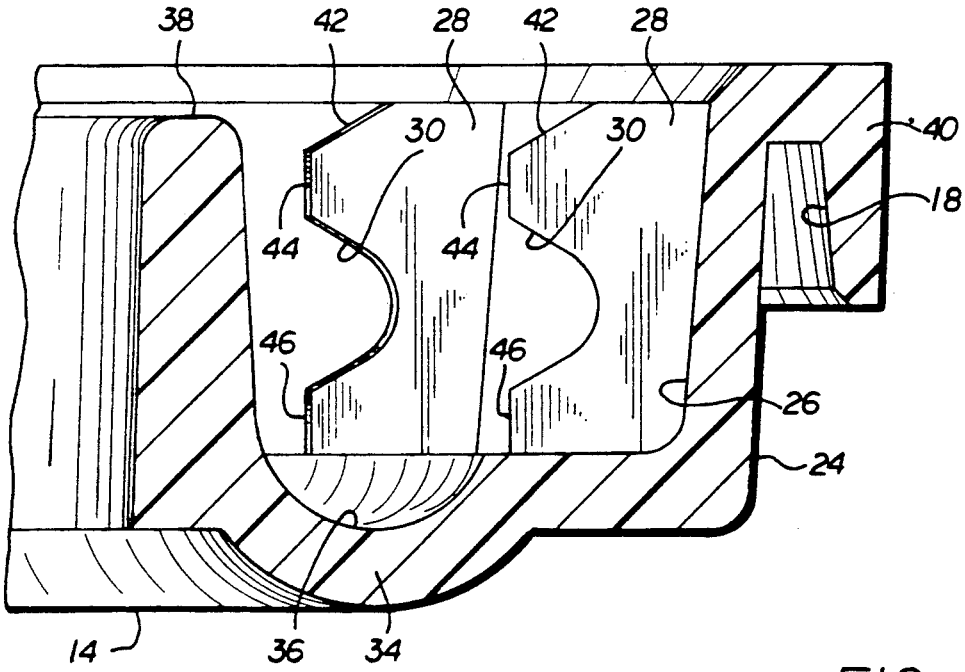
FIG. 4 is a cross-sectional view taken in the direction of arrows 4—4 shown in FIG. 3.

FIGS. 1 and 2 show a preferred embodiment of a closure assembly 10 for use with a container 12. The container 12 is preferably injection molded from a durable plastic material such as a high density polyethylene copolymer, HiD 9118, Pail Grade, sold by Chevron, or the like. However, any suitable material may be used for the container 12 such as metal, or the like. One advantage of using plastic material is that the container will not rust. The container 10 is preferably used as a paint container, but may be used for other purposes. In addition, the container 12 may have connections 13 at the outside thereof for connecting a carrying wire.

An annular snap ring 14 adapted to be mounted on the container 10 is shown in FIGS. 2 through 6. When mounted, as shown in FIG. 2, the snap ring 14 forms part of the closure assembly 10 and functions like a rim for the container 12. The snap ring 14 has an annular outer portion 16 with an annular channel 18 therein. As discussed below and shown in FIG. 2, an upper portion 20 of the container 12 engages annular channel 18 and is spin welded to outer portion 16 at channel 18 with inside surface 22 of the container 12 in contact with outside surface 24 of the ring 14. The snap ring 14 is preferably injection molded from durable plastic such as high density polyethylene copolymer (as discussed above), but any suitable material may be used for the ring 14, such as metal.

Referring again to FIG. 2, the snap ring 14 has an annular inside surface 26 with a plurality of engaging members 28 attached thereto, or integrally-formed with the ring 14 during injection molding. Each engaging member 28 has a groove 30 therein. Any desirable number of engaging members 28 may be used to keep a lid 32 secured shut on top of the container 12, as is discussed below. Each adjacent pair of engaging members 28 are spaced a distance 64 (See FIG. 3) apart, and distance 64 may vary circumferentially around the snap ring 14 if desired. Preferably, about 20 engaging members 28 equally spaced circumferentially around the snap ring 14 are used for the closure assembly 10 (see FIG. 3). However, engaging members 28 may be unequally spaced around the snap ring 14 if desired. As shown in FIG. 2, the snap ring 14 has an annular downwardly extending portion 34 with an annular groove 36 therein, and an annular upwardly extending portion 38.

FIGS. 3 through 6 show another embodiment of the snap ring 14 having an outer portion 40 with ninety degree corners, and engaging members 28 with straight edges 42, 44 and 46 to better facilitate manufacturing of the ring 14. However, it is important to note that outer portions 16 and 40 and engaging members 28 may have any desirable shape, and the present invention is not limited by the shapes of these parts.

Figure 5:
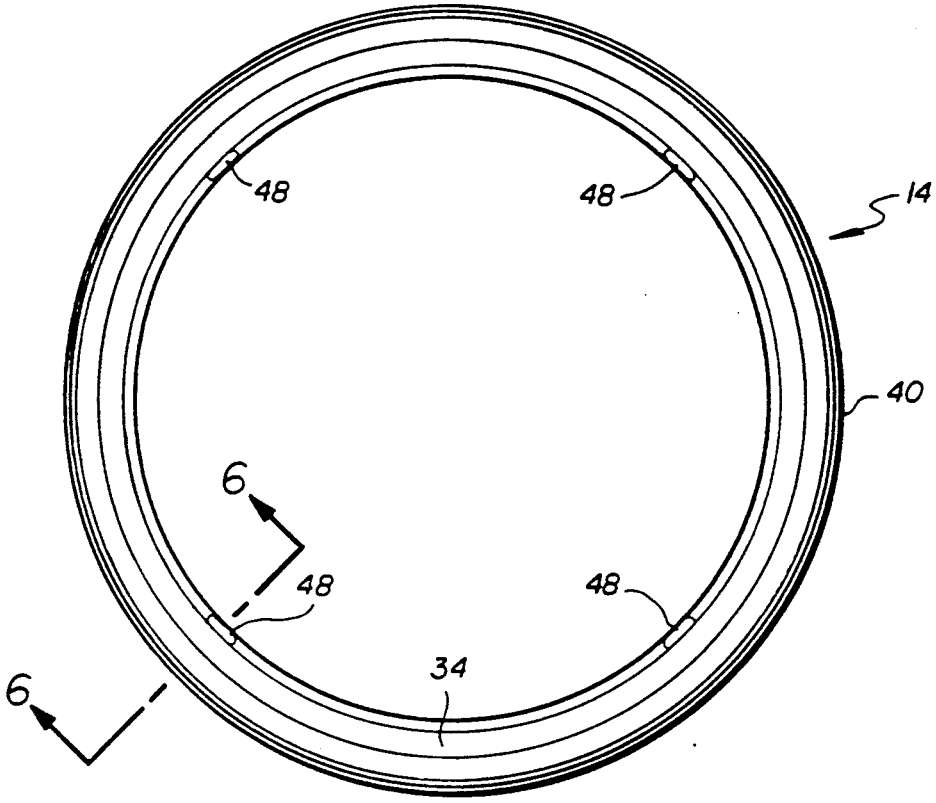
FIG. 5 is a bottom plan view of the snap ring.
Figure 6:
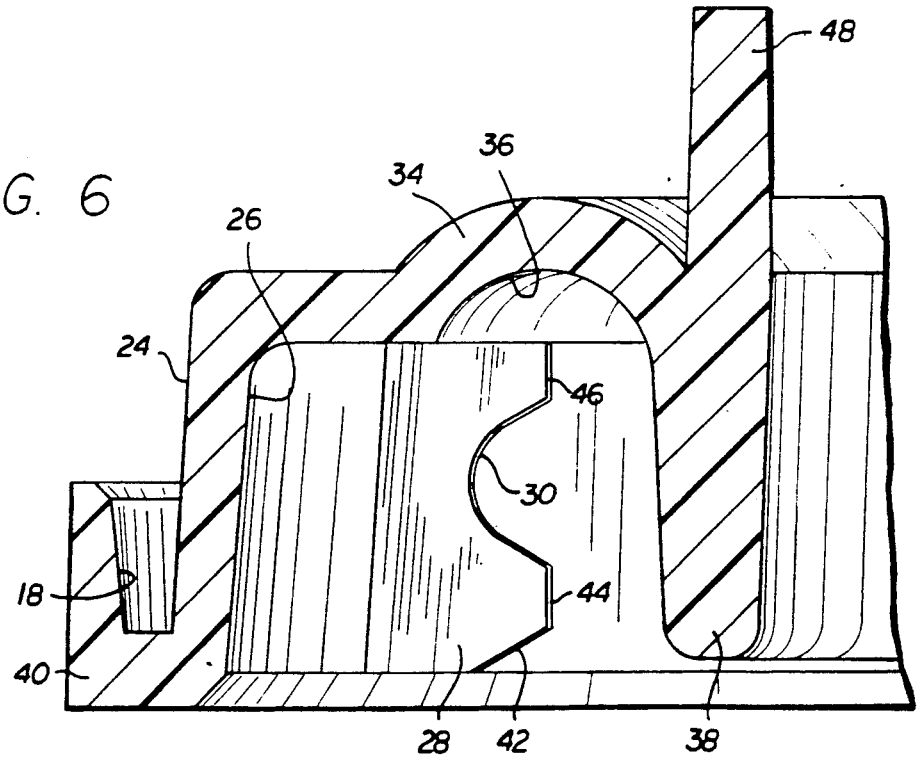
FIG. 6 is a cross-sectional view taken in the direction of arrows 6—6 shown in FIG. 5.

Referring to FIGS. 5 and 6, the snap ring 14 has downwardly extending tabs 48 (note that the snap ring 14 is shown upside down in these figures). Four tabs 48 are preferably used and spaced ninety degrees apart as shown in FIG. 5. The tabs 48 are used to position or hold the snap ring 14 in place when the ring 14 is spin welded or otherwise attached to upper portion 20 of the container 12 at channel 18.

The lid 32, which also forms part of the closure assembly 10, is shown in FIGS. 1, 2, 8 and 9. Preferably, the lid 32 is injection molded from a durable plastic material such as high density polyethylene copolymer (as discussed above). However, any suitable material may be used such as metal. The lid 32 has an annular bead 50 at an outer circumferential surface 52 thereof, an annular downwardly extending portion 54, and an annular upwardly extending portion 56 with an annular groove 58 therein. A round, flat portion 60 extends across the top of the lid 32.

As shown in FIG. 2, the lid 32 may be engaged to the snap ring 14 by pushing downward on the lid 32 causing portion 38 of the ring 14 to engage groove 58 in portion 56 of the lid 32, portion 54 of the lid 32 to engage groove 36 in portion 34 of the ring 14, and annular bead 50 of the lid 32 to engage grooves 30 in the engaging members 28 of the ring 14. As a result, a secure seal is obtained between the lid 32 and snap ring 14 due to the engagement of the different parts of the lid 32 and ring 14, preventing paint or other liquid from leaking from the container 12.

The lid 32 may be easily removed from the snap ring 14 by placing the end of a screwdriver or other tool between the engaging members 28 and under the annular bead 50, and then using the top edge 62 of the snap ring 14 for leverage in order to pry the lid 32 free of the ring 14. As such, the distance 64 (see FIG. 3) between the engaging members 28 provides room for inserting a tool between the members 28, facilitating removal of the lid 32 from the snap ring 14.

Preferably, the container 12, snap ring 14 and lid 32 are injection molded from plastic material in order to provide a lightweight container 12 and closure assembly 10. However, other materials may be used if desired. The simple design of closure assembly 10 provides a product that is economical to manufacture using standard molding procedures. In addition, the container 12, snap ring 14 and lid 32 are used together and may be sold as a single product.

The above description describes the preferred embodiments of the present invention. However, persons of ordinary skill in the art are capable of numerous modifications once taught these principles. Accordingly, it will be understood by those skilled in the art that changes in form and details may be made to the above-described embodiments without departing from the spirit and scope of the invention.

I claim:

1. A closure assembly for use with a container, comprising:

a snap ring to be mounted on said container, said snap ring having a plurality of separate engaging members circumferentially spaced and separated around said snap ring, each of said engaging members having an engaging groove therein, each of said engaging members extending radially inwardly from an annular inside surface of an annular outer portion of said snap ring; and a lid having an annular bead at an outer circumferential surface thereof, said annular bead adapted to releasably engage said engaging grooves of said engaging members in order to releasably attach said lid to said snap ring.

2. The closure assembly of claim 1 wherein said snap ring has an annular downwardly extending portion with an annular groove therein and an upwardly extending annular portion located radially inward from said downwardly extending portion, and said lid has an annular downwardly extending portion and an annular upwardly extending portion with an annular groove therein, said downwardly extending portion of said lid releasably engaging said annular groove of said snap ring and said upwardly extending portion of said snap ring releasably engaging said annular groove of said lid in order to attach said lid to said snap ring and to provide a seal.

3. The closure assembly of claim 2 wherein said snap ring has about 20 equally spaced engaging members.

4. The closure assembly of claim 2 wherein said snap ring has an annular circumferential channel therein, said channel engaging said container.

5. A closure assembly for use with a container, comprising:

an annular snap ring to be mounted on said container;

a lid releasably engaged to said snap ring;

means located circumferentially around said lid for releasably engaging said snap ring; and a plurality of separate engaging means circumferentially spaced and separated around said snap ring for releasably engaging said lid, each of said plurality of separate engaging means extending radially inwardly from an annular inside surface of an annular outer portion of said snap ring.

6. The closure assembly of claim 5 wherein said means for releasably engaging said snap ring comprises an annular bead at an outer circumferential surface of said lid.

7. The closure assembly of claim 6 wherein said plurality of separate engaging means comprises a plurality of equally spaced engaging members located circumferentially around said snap ring, each of said engaging members having an engaging groove therein.

8. The closure assembly of claim 7 wherein said snap ring has about 20 equally spaced engaging members.

9. The closure assembly of claim 8 wherein said snap ring has an annular downwardly extending portion with an annular groove therein and an upwardly extending annular portion located radially inward from said downwardly extending portion, and said lid has an annular downwardly extending portion and an annular upwardly extending portion with an annular groove therein, said downwardly extending portion of said lid releasably engaging said annular groove of said snap ring and said upwardly extending portion of said snap ring releasably engaging said annular groove of said lid in order to attach said lid to said snap ring and to provide a seal.

10. The closure assembly of claim 9 wherein said snap ring has four downwardly extending tabs equally spaced circumferentially around said ring.

11. The closure assembly of claim 10 wherein said snap ring has an annular circumferential channel therein, said channel engaging said container.

12. The closure assembly of claim 7 wherein said snap ring, said lid and said container are made out of plastic.

13. The closure assembly of claim 1 wherein said snap ring, said lid and said container are made of plastic.

14. A closure assembly for use with a plastic container, comprising:

a plastic snap ring to be mounted on said container, said snap ring having a plurality of separate engaging members circumferentially spaced and separated around said snap ring, each of said engaging members being integrally molded with said snap ring and having an engaging groove therein, each of said engaging members extending radially inwardly from an annular inside surface of an annular outer portion of said snap ring; and a plastic lid having an integrally molded annular bead at an outer circumferential surface thereof, said annular bead adapted to releasably engage said engaging grooves of said engaging members in order to releasably attach said lid to said snap ring and to form a seal between said snap ring and said lid.

15. The closure assembly of claim 14 wherein said snap ring has an annular downwardly extending portion with an annular groove therein and an upwardly extending annular portion located radially inward from said downwardly extending portion, and said lid has an annular downwardly extending portion and an annular upwardly extending portion with an annular groove therein, said downwardly extending portion of said lid releasably engaging said annular groove of said snap ring and said upwardly extending portion of said snap ring releasably engaging said annular groove of said lid in order to attach said lid to said snap ring and to provide a seal.

16. The closure assembly of claim 15 wherein said snap ring has about 20 equally spaced engaging members.

17. The closure assembly of claim 16 wherein said snap ring has an annular circumferential channel therein, and channel engaging said container.

18. The closure assembly of claim 17 wherein said snap ring has four downwardly extending tabs equally spaced circumferentially around said ring.

19. A container comprising:

a generally cylindrical member having a bottom and an open top;

an annular snap ring to be mounted on said top of said cylindrical member;

a lid releasably engaged to said snap ring;

means located circumferentially around said lid for releasably engaging said snap ring; and a plurality of separate engaging means circumferentially spaced and separated around said snap ring for releasably engaging said lid, each of said plurality of separate engaging means extending radially inwardly from an annular inside surface of an annular outer portion of said snap ring.

20. The container of claim 19 wherein said means for releasably engaging said snap ring comprises an annular bead at an outer circumferential surface of said lid.

21. The container of claim 20 wherein said plurality of separate engaging means comprises a plurality of spaced engaging members located circumferentially around said snap ring, each of said engaging members having an engaging groove therein.

22. The container of claim 21 wherein said cylindrical member, said snap ring and said lid are molded from plastic.

* * * * *